US006797070B2

(12) United States Patent
Boyce

(10) Patent No.: US 6,797,070 B2
(45) Date of Patent: Sep. 28, 2004

(54) METHOD FOR CLEANING A COOLER APPARATUS

(76) Inventor: John Darryl Boyce, 44 DeLoaks Dr., Madisonville, LA (US) 70447

( * ) Notice: Subject to any disclaimer, the term of this patent is extended or adjusted under 35 U.S.C. 154(b) by 86 days.

(21) Appl. No.: 09/908,335

(22) Filed: Jul. 17, 2001

(65) Prior Publication Data

US 2003/0015313 A1 Jan. 23, 2003

(51) Int. Cl.[7] ..... B08B 3/10; B08B 9/00; B08B 9/023; B08B 9/027; F28G 9/00

(52) U.S. Cl. ..... 134/10; 134/19; 134/22.1; 134/22.11; 134/22.14; 134/22.18; 134/22.19; 134/26; 165/95

(58) Field of Search ..... 134/10, 19, 22.1, 134/22.11, 22.12, 22.14, 22.18, 22.19, 26; 165/95

(56) References Cited

U.S. PATENT DOCUMENTS 4,645,542 A * 2/1987 Scharton et al. ..... 134/1
4,655,846 A * 4/1987 Scharton et al. ..... 134/1
4,972,805 A * 11/1990 Weems ..... 122/383
5,006,304 A * 4/1991 Franklin et al. ..... 376/316
5,019,329 A * 5/1991 Franklin et al. ..... 376/316
5,425,814 A * 6/1995 Krajicek et al. ..... 134/22.1
6,379,444 B1 * 4/2002 Adkins et al. ..... 106/31.6

* cited by examiner

*Primary Examiner*—Zeinab El-Arini
(74) *Attorney, Agent, or Firm*—Dorsey & Whitney LLP

(57) ABSTRACT

A method for cleaning a lubricating oil cooler apparatus in situ with a cleaning liquid which includes introducing a cleaning liquid that is compatible with lubricating oil into the shell to cause cleaning of the shell and the external surfaces of the tube bundle. The cleaning liquid is recirculated in the shell to remove contaminants from the shell and the cleaning liquid is filtered after it has passed through the shell to remove contaminants from the cleaning liquid. The cleaning liquid is removed from the shell.

12 Claims, 3 Drawing Sheets

METHOD FOR CLEANING A COOLER APPARATUS

This invention relates to an apparatus and method for cleaning a shell-type cooler in situ and cleaning liquid for use therewith and more particularly to an apparatus and method for cleaning a cooler used for cooling turbine lubrication.

In large power generation plants, coolers have heretofore been provided for cooling the lubricating oil for lubricating the bearings of turbines. Such lubricating oils create a hydrodynamic film between the bearing and the shaft of the turbine to maintain a separation between the metal surfaces. Because of friction, the lubricating oil becomes heated as it travels through the lubricating system which includes oil reservoirs and recirculating pumps. The coolers are utilized to keep lubricating oil at temperatures which are within operating limits to protect the bearings, control valves, etc. of turbines and also to prevent deterioration of the lubricating oil due to contamination or degradation. The cooler utilized is in effect a heat exchanger which can be mounted vertically or horizontally and typically is of a shell type which includes a tube bundle, a shell enclosing the tube bundle and a head. The tube bundle serves as a cooling element with cooling water flowing inside of the tubes and lubricating oil flowing in the shell over the outsides of the tubes. The head has channel-type ports that cause the cooling water to pass through all of the tubes of the tube bundle. The shell retains the turbine lubricating oil which flows over the tubes. The tubes are clamped to the shell and are sealed using o-rings to assure that the water and oil do not come into contact with each other. The cooler and the system associated therewith acts as a catch basin for oil contaminants such as varnish deposits and other foreign matter that may effect the efficiency of the cooler. It is therefore necessary to periodically clean the coolers to maintain their efficiency. Various procedures have been utilized in the past to clean coolers. One approach has been to pull the tube bundle from the shell and soak the tube bundle in a vat of chemicals and/or petroleum solvents to remove the contaminants on the outside of the tubes. This generally is undesirable because the chemicals require special handling and are difficult to dispose of properly to meet environmental standards. In addition, removal of the tube bundles from the shell requires special handling to prevent damage to the tube bundles. Also there is the possibility of damage to the shell during the bundle removal. Typically such tube bundles when replaced must be pressure tested. There is therefore a need for a new and improved apparatus and method for cleaning a cooler in situ.

In general, it is an object of the present invention to provide an apparatus and method for cleaning a shell-type cooler in situ and a lubricant for use therewith.

Another object of the invention is to provide an apparatus and method of the above character which does not require removal of the tube bundle from the shell.

Another object of the invention is to provide an apparatus and method of the above character in which the tube bundle and the shell interior can be cleaned without danger of damaging interior parts.

Another object of the invention is to provide an apparatus and method of the above character in which a cooler of either a dual type or a single type can be cleaned.

Another object of the invention is to provide an apparatus and method of the above character in which the cooler is isolated from the reservoir and other hydraulic lines to prevent interference with the cleaning.

Another object of the invention is to provide a cleaning liquid for use with the apparatus and method of the present invention.

Additional objects and features of the invention will appear from the following description in which the preferred embodiment is set forth in detail in conjunction with the accompanying drawings.

DETAILED DESCRIPTION OF THE PREFERRED EMBODIMENT

In general, the apparatus for cleaning a shell-type cooler in situ with the cooler being of a type having a tube bundle for receiving cooling water for passage therethrough, a shell surrounding the tube bundle and carrying oil inlet and oil outlet connections comprises oil inlet valving coupled to the oil inlet of the shell and oil outlet valving connected to the oil outlet of the shell. A filter is provided having an inlet and an outlet. Piping is provided for connecting the outlet of the filter to the oil inlet of the shell and piping is provided for connecting the outlet of the shell to the inlet of the filter. A cleaning liquid fills the shell surrounding the tube bundle and fills the piping. A pump is provided in the piping for pumping the cleaning liquid through the piping and through the shell enclosing the tube bundle for cleaning the tube bundle and the shell and for removing contaminants from the tube bundle and the shell.

Figure 1:
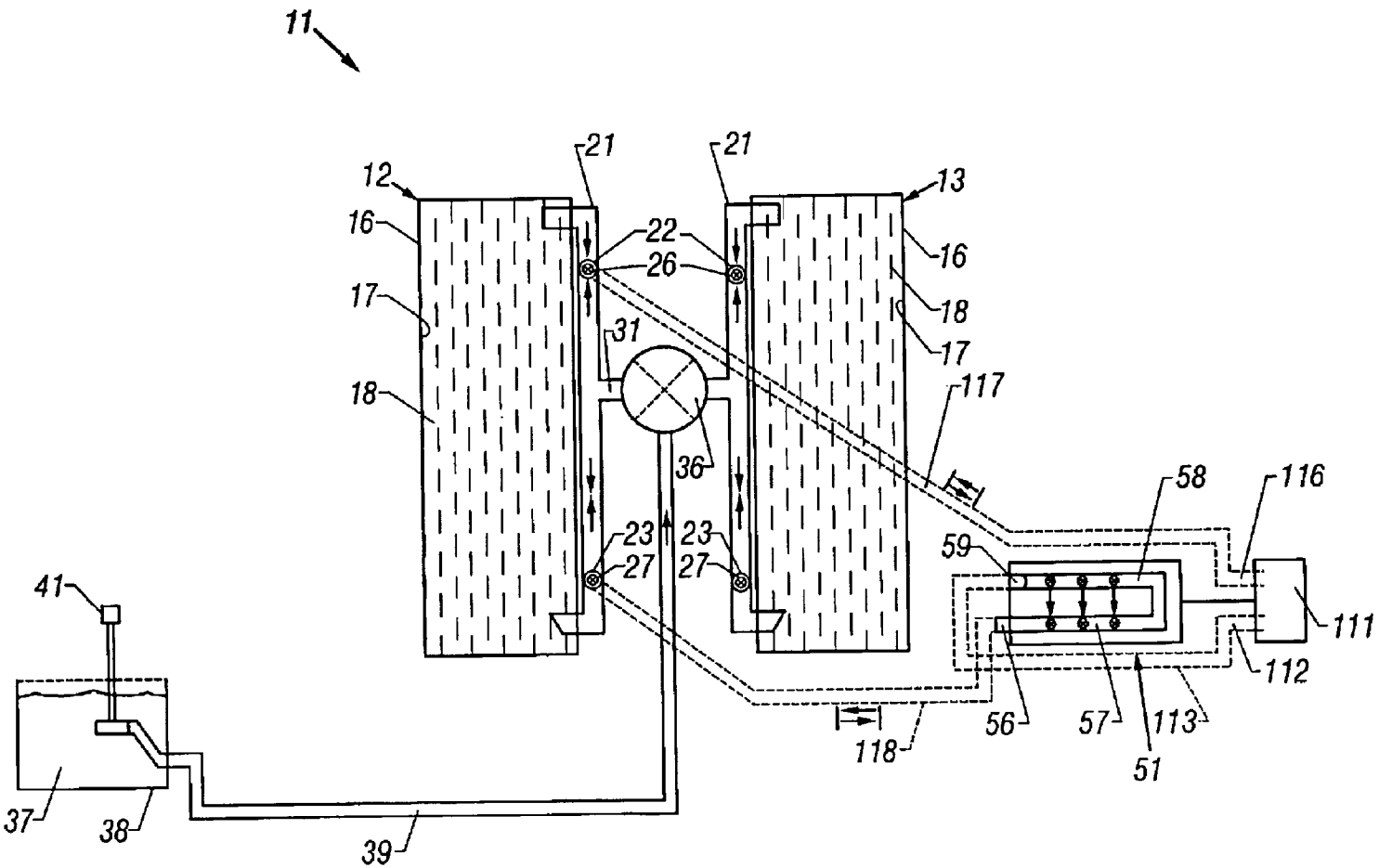
FIG. 1 is a schematic diagram of an apparatus incorporating the present invention for cleaning a cooler in situ.

More in particular, the cooler or cooler apparatus 11 which is of the type which is to be cleaning in accordance with the present invention is shown schematically in FIG. 1. As shown therein, the cooler or cooler apparatus 11 is of a dual type which typically is utilized in power plants for cooling the lubricating oil being supplied to the bearings, control valves, etc. of turbines in the power plant. It should be appreciated that the cooler can be of a single type rather than the dual type shown in the drawing.

The cooler or cooler apparatus which is a dual type consists of two sections 12 and 13. Each of the sections 12 and 13 is provided with an external shell 16 which is provided with an internal space 17 that has contained therein a tube bundle or sheet 18 through which the cooling liquid, typically water, flows for cooling the lubricating oil which flows within the internal space 17 of the shell 16. The external piping 21 is provided with external flanges 22 and 23 which have been provided to make it possible to utilize the apparatus and method of the present invention without damaging the cooler shell itself because of the high rates of flow which are utilized in the method of the present invention. Typically such flanges 22 and 23 connect into six inch lines. The flanges 22 and 23 while not being utilized in connection with the present invention may be closed off by bolted on plates (not shown). Valves 26 and 27 are mounted on the flanges 22 and 23. The valves 26 and 27 can be of a suitable type such as four-inch ball valves.

The external piping 21 is provided with a tee 31 connected into the piping 21 midway between the flanges 22 and 23 which is connected into a three-way valve 26 that is utilized for isolating the sections 12 and 13 from each other during the cleaning procedure as hereinafter described and which is also utilized for supplying lubricating oil 37 from a reservoir 38 through piping 39 connected into the three-way valve 36. A motor driven pump 41 is provided in the reservoir 38 for supplying lubricating oil to the three-way valve 36 to ensure that the shell 16 of each of the sections 12 and 13 is filled with lubricating oil.

Figure 2:
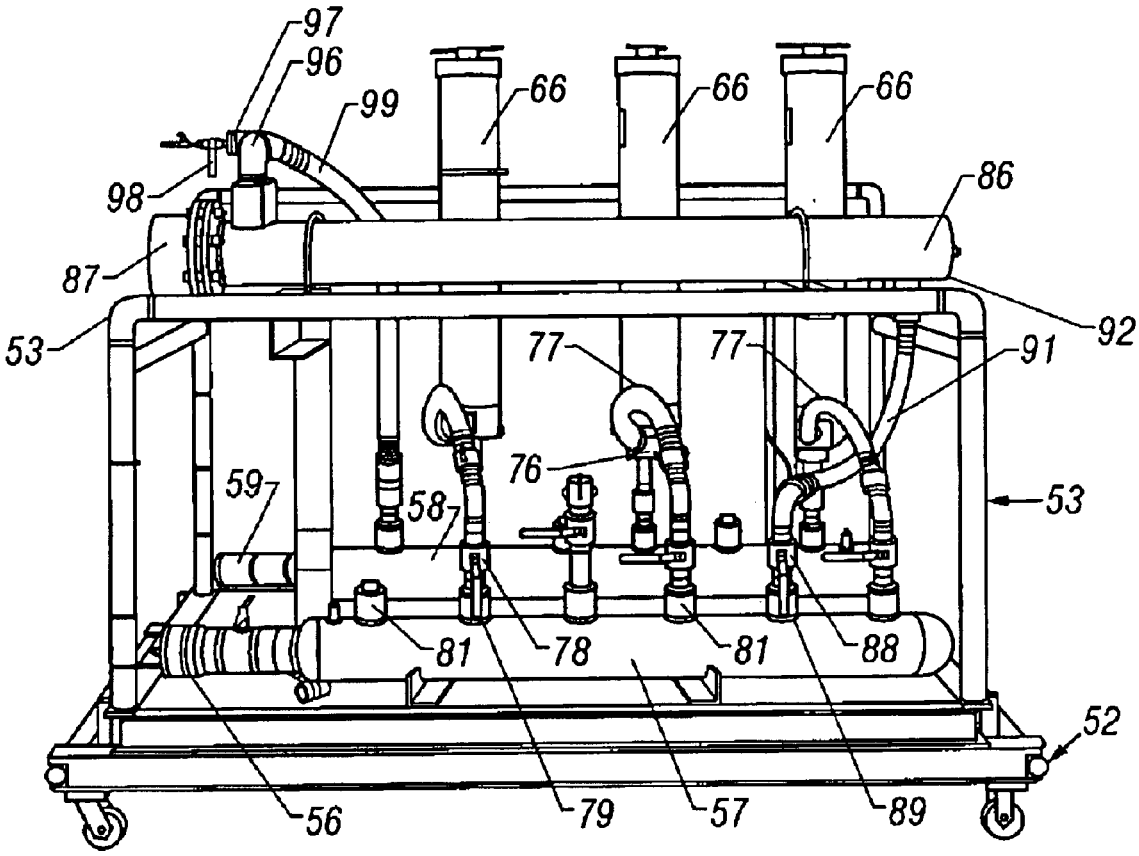
FIG. 2 is a perspective view of the apparatus shown in FIG. 1.
Figure 3:
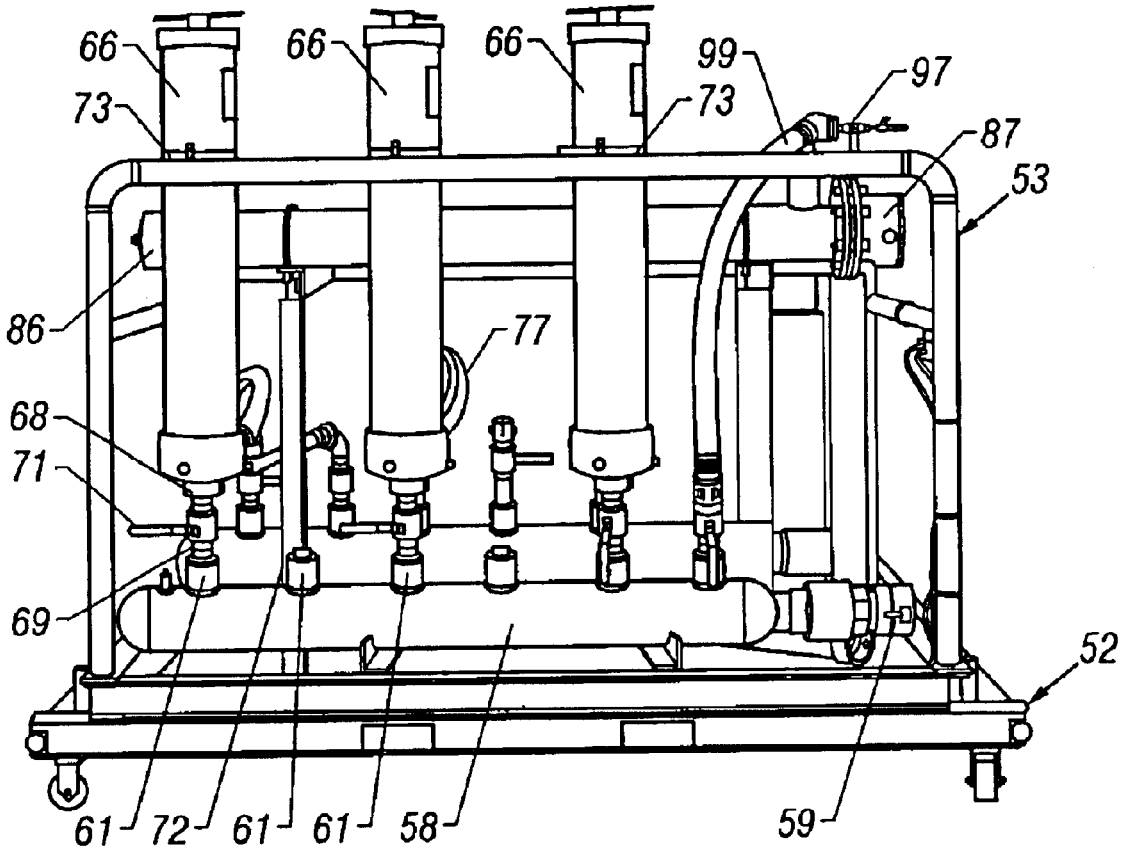
FIG. 3 is another perspective view of the apparatus shown in FIG. 1 but shown from the opposite side.

The apparatus 51 for cleaning the shell-type cooler or cooler apparatus 11 in place or in situ is shown schematically in FIG. 1 and is shown more in detail in FIGS. 2 and 3. As shown in FIGS. 2 and 3, the apparatus 51 consists of a skid on wheeled platform 52 which has an upstanding pipe frame work 53 mounted thereon. The apparatus is provided with an inlet 56 which is mounted on one end of a large manifold 57 of a suitable size as for example a six-inch diameter pipe which is mounted on the platform 52 and extends the length thereof. An outlet manifold 58 is also mounted on the platform 52 and is of the same size as the manifold 57 and extends in a spaced apart position parallel to the manifold 57 on the platform 52 and lies in a common plane with the manifold 57.

The outlet manifold 58 is provided with an outlet fitting 59 on the same end of the wheeled platform 52 as the inlet 56. A plurality of upstanding fittings 61 as for example six are provided on the outlet manifold 58 in spaced apart positions. A plurality of filters or filter pods 66 are mounted on the fittings 61 of the outlet manifold 58 and have outlets 68 which are directly connected into the fittings 61. Each of the outlets is provided with a valve 69 which can be manually operated between open and closed positions by a handle 71. As shown, only three filter pods 66 have been provided with the rest of the fittings 61 being capped off by threaded end caps 72. The filter pods 66 can be of a suitable type such as those manufactured by Porous Media of Minneapolis, Minn., such as a three micrometer absolute, beta 200 filter. The filters 66 are secured by brackets 73 to the pipe framework 53. Each of the filter pods 66 is provided with an inlet 76 entering from the side of the filter immediately above the outlet 68. The inlets 76 are connected by flexible hoses 77 to valve assemblies 78 having operating handles 79. The valve assemblies 78 are mounted on upstanding fittings 81 extending upwardly from the inlet manifold 56. The fittings 81 are spaced apart longitudinally of the inlet manifold 57 and extend upwardly therefrom and are in general alignment with the fittings 61 provided on the outlet manifold 58.

A heater 86 is mounted in the upper part of the framework 53 and extends longitudinally thereof generally parallel to the manifolds 57 and 58. The heater 86 is utilized for heating the cleaning liquid utilized for cleaning the cooler apparatus 11 and can be of a suitable type such as one in which thermostatically controlled Calrod heating elements (not shown) are mounted on an end fitting 87 mounted in one end of the cylindrical heater 86.

The cleaning liquid entering the inlet manifold 57 and to be heated by the heater 86 is supplied through the fittings 81 through a valve assembly 88 provided with a handle 89. The valve assembly 88 is connected to one end of the heater 86 by a flexible hose 91 and fitting 92. The cleaning liquid passes through the heater 86 and exits through a fitting 96 provided on the opposite end of the heater 86. The fitting 96 has a valve assembly 97 mounted thereon having a handle 98. a hose 99 is connected to the valve assembly 97 and is connected to one of the fittings 61 on the outlet manifold 58 adjacent to the outlet fitting 59.

The cooler apparatus 11 also includes a pump unit 111 as shown schematically in FIG. 1 which typically is mounted on a separate dolly or wheeled platform (not shown) and is provided with its own separate electrical control panel. The pump unit 111 can be of a suitable size as for example a pump having a capacity of 550 gallons a minute and driven by a 50 horsepower electrical motor. The pump unit 111 has an inlet 112 which is connected by suitable piping as for example a flexible hose 113 to the outlet fitting 59 of the apparatus 51. The pump unit 111 is provided with an outlet 116 which is connected by a flexible hose 117 to the flange 22 of the cooler apparatus 11. The inlet fitting 56 of the filter apparatus 51 is connected by a flexible hose 118 to the valve 27 connected to the flange 23.

It should be appreciated that if desired the pump size can be increased as well as the size of the filter capacity of the apparatus 51 by increasing the number of filter pods 66 with each filter pod having a capacity of 250 gallons per minute, an increase to five filter pods provides the capability of treating 1,250 gallons per minute. The amount of cleaning liquid to be heated can be readily controlled by use of the valve assemblies 88 and 98.

In connection with the apparatus and method of the present invention it has been found desirable to utilize a specialized cleaning liquid which is particularly adapted for the cleaning of a cooler apparatus of the type herein discussed and which will not have deleterious effects on rubber seals and metals used in the tube bundles of the cooler apparatus.

The special cleaning liquid for use with the apparatus and method of the present invention may now be briefly described as follows. It has been found that a special cleaning liquid particularly useful in the cleaning of the cooling apparatus 11 using the method described consists of technical white oil which is commercially available as for example from Penreco or Base 2260 to which has been added an additive in the range of 2 to 10% by volume dependent upon the various parameters of the cooling systems which may include, by way of example, cooler size, position of cooler and condition of lubricating oil, and preferably approximately 2.5% by volume. One additive found to be particularly suitable is DPNP glycol ether, more particularly dipropylene gylcol n-propyl ether supplied by Dow Chemical under CAS No. 029911-27-1. In preparing the cleaning liquid technical white oil and the additive are blended by mixing the desired volumes in an apropriate container by merely pouring the two liquids into a single container as for example a container having total combined volume of 300 to 600 gallons depending upon the design of the cooler. It has been found that this mixture of this special cleaning liquid is particularly efficacious in performing the cooler cleaning operation hereinafter described. The special cleaning liquid also does not have deleterious effects on the rubber seals used in the cooler apparatus. Seal swell tests confirm these observations. In addition it has been found that this special liquid also does not have any deleterious effects on the shell or on the tube bundle.

Operation and use of the apparatus in performing the method of the present invention for cleaning cooling apparatus utilizing the specialized cleaning liquid hereinbefore described can be briefly described as follows. Let it be assumed that it is desired to clean a shell-type cooler apparatus provided in a power plant of an electrical generating station. Let it also be assumed that the turbine or turbines to which the lubricating oil is supplied have been shut down. Thereafter, the three-way valve 36 is operated to isolate the cooler apparatus from the reservoir 38 and other piping. The cooler apparatus 11 is then drained of all lubricating oil. Thereafter, water flow through the tube bundle or sheet 18 is terminated. If the flanges 22 and 23 as well as the associated valves 26 and 27 have not been provided in the external piping 21, these are now added. As soon as this has been completed, the flexible hoses 117 and 118 can be connected to the valves 26 and 27 and thereafter, the shell 16, hoses 117 and 118, and the filter apparatus 51 can be filled with the special cleaning liquid brought onto the site in a container. The amount of special cleaning liquid required is calculated with respect to the size of the cooler apparatus 11 to be cleaned. The special cleaning liquid can be gravity fed into the shell or alternatively pumped into the shell 16 until the shell 16 and associated piping have been filled as full as possible without overfilling or spilling special cleaning liquid outside the shell. This filling can be accomplished by pumping the special liquid at a slow speed as for example in a range from 5 gallons to 15 gallons per minute while venting air from the shell until the shell has been filled.

The shell 16 and the associated piping after being filled with the special cleaning liquid is permitted to soak for a suitable period of time without pumping or stirring of the cleaning liquid as for example for a period of several hours to three days to loosen up contaminants such as scale, rust, varnish and the like which have built up in the shell 16 and on the tube bundle or sheet 18.

After the desired amount of soaking has occurred, pumping of the special cleaning liquid is commenced by use of the pump unit 111 to pump the special cleaning liquid for a predetermined period of time of at least 18 hours with additional pumping being provided if desired up to approximately 36 hours depending upon the design of the cooler. During this pumping operation, the special cleaning liquid is heated to a temperature preferably above 120° F. but not to exceed a temperature of approximately 170° F. The heating of the special cleaning liquid which typically can range from 300 to 600 gallons for each cooler apparatus takes time. The rapidity of the heating can be controlled by controlling the amount of special cleaning liquid passing through the heater by controlling the associated valving hereinbefore described. Overheating is prevented by the use of a thermostat (not shown) provided in the heater which turns off the heating elements when the desired maximum temperature has been reached.

During this pumping operation, it may be desirable to check particle counts of ASTM, ISO specifications in the special cleaning liquid as it is being recirculated by the pump 111 to ascertain when the particle count is near or below the manufacturer's specification for the lubricating oil used in the cooler apparatus. As soon as the desired minimum particle count has been achieved, the operation of the pump unit 111 can be terminated. During the operation of the pump unit, the special cleaning liquid will be circulated through the filter apparatus at a relatively high rate as for example 50 to 600 gallons per minute but not at a pressure in excess of 75 psi to facilitate removal of contaminants from the shell 16 and the tube bundle or sheet 18. In this way it can be seen that the special cleaning liquid is circulated through the filter bank in a kidney-loop type system. The special cleaning liquid as it passes through the shell of the cooler apparatus acts as a cleaner and carries out the contaminants which are removed by the filter pods 66.

When the desired amount of cleaning has been accomplished, the pump unit 111 is stopped and thereafter, the specialized cleaning liquid is drained from the cooler apparatus. This can be accomplished by use of the pump 111 but typically because of its high capacity, it is desirable to utilize a smaller pump (not shown) having a lower flow rate for draining the special cleaning liquid from the cooler apparatus 11. By way of example the special liquid can be drained and pumped into the container utilized for bringing the special cleaning liquid to the power plant site. The container can then be removed from the site and the special cleaning liquid disposed of in an environmentally safe manner.

After the cooler apparatus 11 has been drained of the special cleaning liquid, it is then filled with a washing or flushing liquid which is compatible with the operating turbine oil and cleaning liquid. If desired, operating turbine oil may be used for this flushing liquid. This flushing liquid can be circulated through the cooler apparatus by the use of the filter apparatus 51. Prior to use in this flushing operation, the filter pods 66 if desired can be changed so that any contaminants collected by the filter pod units during the time that special cleaning liquid is being circulated therethrough are removed. The flushing liquid can be pumped by the use of the apparatus 51 at a pumping rate ranging from 100 to 1,000 gallons per minute through the cooler apparatus at a pressure not exceeding 75 psi for removal of any remaining contaminants within the shell and also to ensure removal of any specialized cleaning liquid residue remaining in the shell. The flushing fluid is then drained and removed from the site and disposed of in an appropriate, proper used oil disposal procedure. If the specialized cleaning liquid and the flushing liquid are petroleum-based liquids, they can be disposed of in the same manner as other conventional petroleum-based liquids.

After one section of the cooler apparatus 11 has been cleaned in the manner hereinbefore described, the other section 13 can be cleaned in a similar manner by connecting the pump unit 111 to the flanges 22 and 23 provided on the other section 13. The same procedure as described for cleaning section 13 can be used.

After the cleaning and flushing procedures have been accomplished for one or both sections 12 and 13, the cooler apparatus 11 can be filled with turbine lubricating oil in a conventional manner. The valves 26 and 27 mounted on the flanges 22 and 23 can be closed and the flexible hoses 117 and 118 removed therefrom. The reservoir 38 is filled with new turbine lubricating oil and the pump 41 is utilized to fill the cooler apparatus 11 through the three-way valve 36. After the cooler apparatus 11 has been filled with the new operating turbine oil, water can again be supplied to and circulated in the tube bundle or sheet 18 for cooling the turbine oil which can then be supplied in a conventional manner to the turbines for lubricating the bearings, control valves, etc. of the turbines.

From the foregoing it can be seen that a greatly improved apparatus and method have been provided for the cleaning of cooler apparatus in power plants. The contaminants within the shell and on the tube bundle are removed from the shell with the shell and tube bundle being in situ. Such cleaning of the cooling apparatus improves the cooling efficiency of the cooling apparatus. With the apparatus and method of the present invention there is no need for the removal of the tube sheet from the shell or transportation of the tube sheet, thereby avoiding possible damage to the shell during tube sheet removal or replacement. By utilizing such an apparatus and method, labor costs and down time of the power plant are greatly reduced while improving reliability of the cleaning procedure.

Although the apparatus and process of the present invention have been described principally for use with turbines in electrical power plants it should be appreciated that the apparatus and process or method can be utilized in other applications where heat exchangers are utilized as for example in the petrochemical and refining industries and with gas turbines (simple and combined cycle).

What is claimed:

1. A method for cleaning a lubricating oil cooler apparatus in situ with a cleaning liquid with the lubricating oil cooler apparatus being of the type having a shell and a tube bundle disposed in the shell and external piping connected into the shell, the external piping having an inlet and an outlet and in which a lubricating oil is provided in the shell and in which a cooling water passes through the tube bundle to cool the lubricating oil in the shell, said method comprising the steps of draining the lubricating oil from the shell, terminating the flow of water through the tube bundle, filling the shell with the cleaning liquid to cause cleaning of the shell and the external surfaces of the tube bundle, recirculating the cleaning liquid in the shell to remove contaminants from the shell and filtering the cleaning liquid after it has passed through the shell to remove contaminants from the cleaning liquid, terminating the recirculation of the cleaning liquid, and removing the cleaning liquid from the shell.

2. A method as in claim 1 further including the step of heating the cleaning liquid to a temperature ranging from 120 to 170° F.

3. A method as in claim 1 wherein the cleaning liquid is introduced at a slow rate to facilitate the removal of air from the shell.

4. A method as in claim 1 wherein the cleaning liquid is permitted to soak the tube bundle and the shell.

5. A method as in claim 4 wherein the soak is carried out for a period of time ranging from several hours to three days.

6. A method as in claim 1 wherein the recirculation is carried out for a period of time ranging from 18 hours to 36 hours.

7. A method as in claim 1 wherein said recirculation of the cleaning liquid is at the rate of 50 to 600 gallons per minute without exceeding a pressure of 75 psi.

8. A method for cleaning in situ a lubricating oil cooler apparatus having a shell and a tube bundle disposed in the shell and external piping connected into the shell, the external piping having an inlet and an outlet and in which a lubricating oil is provided in the shell and in which a cooling liquid passes through the tube bundle to cool the lubricating oil in the shell, said method comprising the steps of introducing a cleaning liquid that is compatible with lubricating oil into the shell to cause cleaning of the shell and the external surfaces of the tube bundle, recirculating the cleaning liquid in the shell to remove contaminants from the shell and filtering the cleaning liquid after it has passed through the shell to remove contaminants from the cleaning liquid, terminating the recirculation of the cleaning liquid, and removing the cleaning liquid from the shell.

9. A method as in claim 8 further including the step of heating the cleaning liquid to a temperature ranging from 120 to 170° F.

10. A method as in claim 8 wherein the cleaning liquid is permitted to soak the tube bundle and the shell for a period of time ranging from several hours to three days.

11. A method as in claim 8 wherein the recirculation is carried out for a period of time ranging from 18 hours to 36 hours.

12. A method as in claim 8 wherein said recirculation of the cleaning liquid is at the rate of 50 to 600 gallons per minute without exceeding a pressure of 75 psi.

* * * * *